US005301813A

United States Patent [19]

Schnittjer

[11] Patent Number: 5,301,813

[45] Date of Patent: Apr. 12, 1994

[54] APPARATUS FOR SEPARATING MATERIAL

[76] Inventor: Bradley J. Schnittjer, P.O. Box 67, 303 Franklin St., Delhi, Iowa 52223

[21] Appl. No.: 976,943

[22] Filed: Nov. 16, 1992

[51] Int. Cl.[5] ..... B07B 1/18

[52] U.S. Cl. ..... 209/284; 209/288; 209/400; 209/406; 209/412

[58] Field of Search ..... 209/284, 288, 303, 241, 209/247, 257, 260, 406, 410–412, 400

[56] References Cited

U.S. PATENT DOCUMENTS

| | | | |
|---|---|---|---|
| 447,162 | 2/1891 | Prescott et al. | 209/284 |
| 928,965 | 7/1909 | Hanna | 209/284 X |
| 1,228,800 | 6/1917 | Marshall | 209/284 |
| 1,484,025 | 2/1924 | Hofer | 209/284 |
| 2,269,046 | 1/1942 | Whitehead et al. | 209/284 |
| 3,002,623 | 10/1961 | Fontaine | 209/288 |
| 3,208,593 | 9/1965 | Dietert | 209/288 |
| 3,942,644 | 3/1976 | Vissers | 209/284 X |
| 4,156,508 | 5/1979 | Kisielewski | 209/284 X |
| 5,002,656 | 3/1991 | Johansson | 209/288 X |

*Primary Examiner*—D. Glenn Dayoan
*Attorney, Agent, or Firm*—James C. Nemmers

[57] ABSTRACT

An apparatus for separating materials into different sized particles, especially difficult materials that may contain wet or sticky particles or lightweight foreign material. The material is separated by feeding it into a dish-shaped unit open at the top with screen material along its sides and bottom. The unit is rotated about an inclined axis so that the open top faces upwardly and toward the front. The material to be separated is placed into the unit, and the unit is rotated so that the material rolls on itself across the bottom and up the sides with the smaller particles moving downwardly where they pass through the screened sides and bottom as the unit rotates over a conveyor. The larger particles exit through the open top of the unit. The apparatus also includes a unique way of providing for the screen medium.

5 Claims, 3 Drawing Sheets

APPARATUS FOR SEPARATING MATERIAL

BACKGROUND OF THE INVENTION

Materials have been separated into selected different sizes for a variety of purposes for many, many years. To accomplish the separation, numerous devices and machines have been developed from the very simple to the very complex, depending upon the particular use and the materials to be separated. The prior art devices and machines range from a simple box with a screen wire bottom to very expensive shaker decks or trommels. All of these devices and machines use a screen medium of a specific size and shape which will allow particles smaller than the openings to pass through while the larger particles are retained on the screen, and a suitable method of collecting the various sizes in separate locations is usually combined with the separating device itself. Also, some prior art systems combine one or more screens into a more complex apparatus, so as to separate materials into two or size ranges as the materials passes through the apparatus.

Most prior art devices have a separation screen that is shaped into a cylinder and revolved about an inclined axis. Examples of such revolving screens are shown in Hanna U.S. Pat. No. 928,965 and Dietert U.S. Pat. No. 3,208,593. More complex separating apparatus may add some means for increasing the screening effect, such as an agitator or vibrator. Fulghum, Jr. et al, U.S. Pat. No. 4,140,281 shows a revolving cylindrical screen with an added means for initially separating particles in a specialized application. Other known prior art separators teach banks of flat screens each mounted on an incline with vibrators added to each screen.

An example of a separating apparatus that does not utilize screens but a plurality of revolving disks of different diameters mounted on an inclined axis is shown in Hering U.S. Pat. No. 1,216,118.

The known prior art devices and machines are quite effective when the material to be separated is heavy, firm, granular and dry. However, a variety of waste recovery processes have been developed in recent years which have created a need for a screening method and apparatus that will work effectively and efficiently with difficult materials which are soft, wet, sticky, and may contain lightweight or other foreign materials such as plastic film, or paper particles. Such materials are difficult to efficiently separate, and conventional screens do not perform well since they usually become plugged or blinded. This requires frequent shutdown for manual cleaning or costly equipment to continuously clean the screen medium.

There is therefore a need for an apparatus for separating materials which may contain soft, wet, sticky, or a variety of foreign materials that include lightweight, plastic, and paper particles.

There is a further need for an apparatus for separating these difficult materials efficiently and at a low cost to make the screening apparatus available for a variety of different uses by a variety of different users who conduct both small and large operations.

SUMMARY OF THE INVENTION

The apparatus of the invention includes a dish or bowl-shaped separating unit closed at the bottom and open at the top with a screen medium covering the sides and bottom. The unit is rotatable about an axis inclined to the vertical so that the top faces somewhat upwardly, but more toward the side. Material to be screened is fed into the open top, and as the unit rotates, the orbital action causes the larger and lighter particles to come to the surface. The smaller particles will work their way to the bottom of the unit where the revolving screened sides are located, thus causing the smaller particles to pass through the screen on both the sides and the bottom. Continued feeding fills the unit to overflowing until the over-sized particles simply are discharged out the open front.

DESCRIPTION OF THE PREFERRED EMBODIMENT OF THE INVENTION

Figure 1:
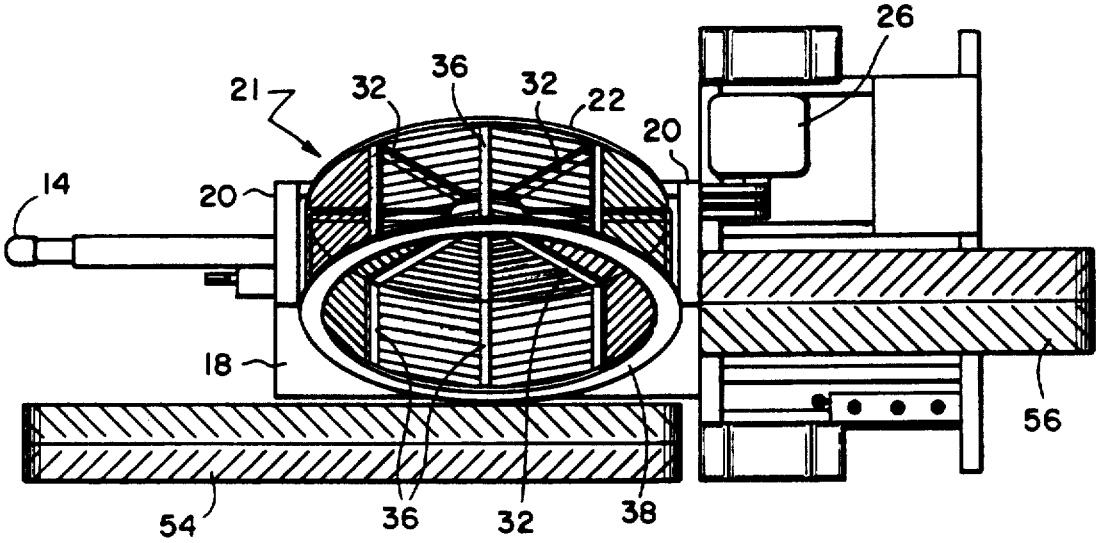
FIG. 1 is a top or plan view of an apparatus constructed according to the invention and showing conveyors for moving the separated material away from the apparatus.
Figure 2:
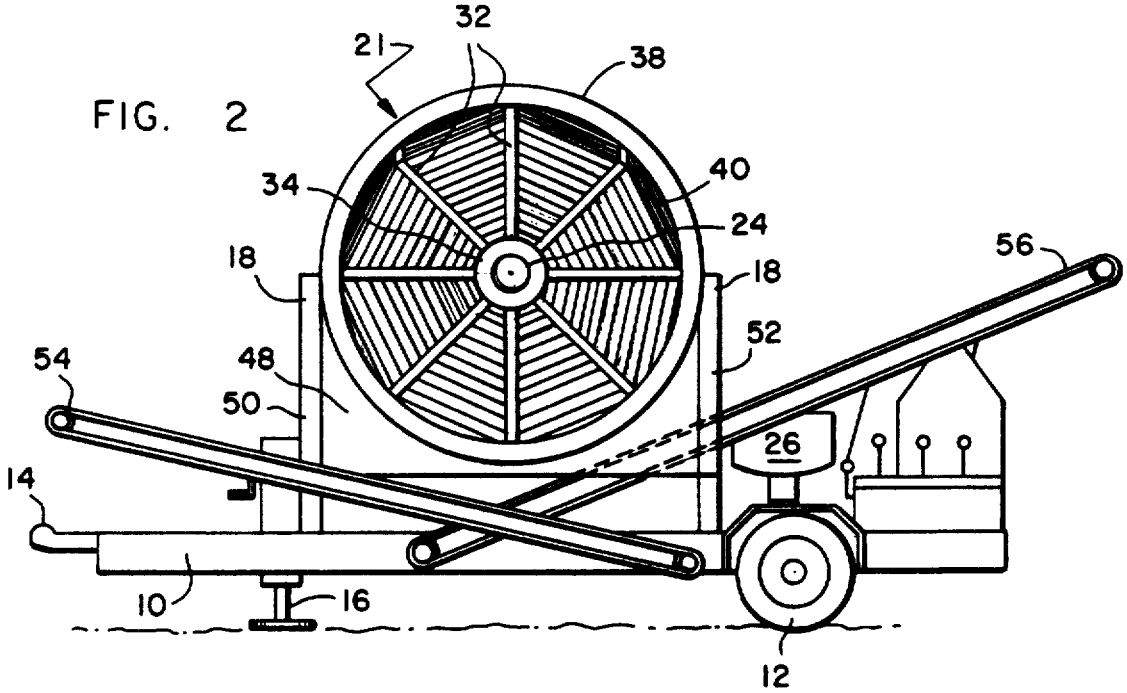
FIG. 2 is a front elevational view of the apparatus of FIG. 1.

In the drawings, there has been illustrated the principles of the invention as applied to a mobile trailer-mounted apparatus with a particular conveyor arrangement for moving away both the smaller and larger size particles. However, an apparatus constructed according to the principles of the invention can be installed at a fixed location, if desired, and different conveyor arrangements combined with the separating unit.

In the drawings, the apparatus is shown as being mounted on a trailer frame 10 that is in turn mounted on ground engaging wheels 12 and includes a hitch 14 for towing. The trailer also includes an extendable support 16 to maintain the apparatus level after it has been towed to the desired site and set in place for operation.

Figure 3:
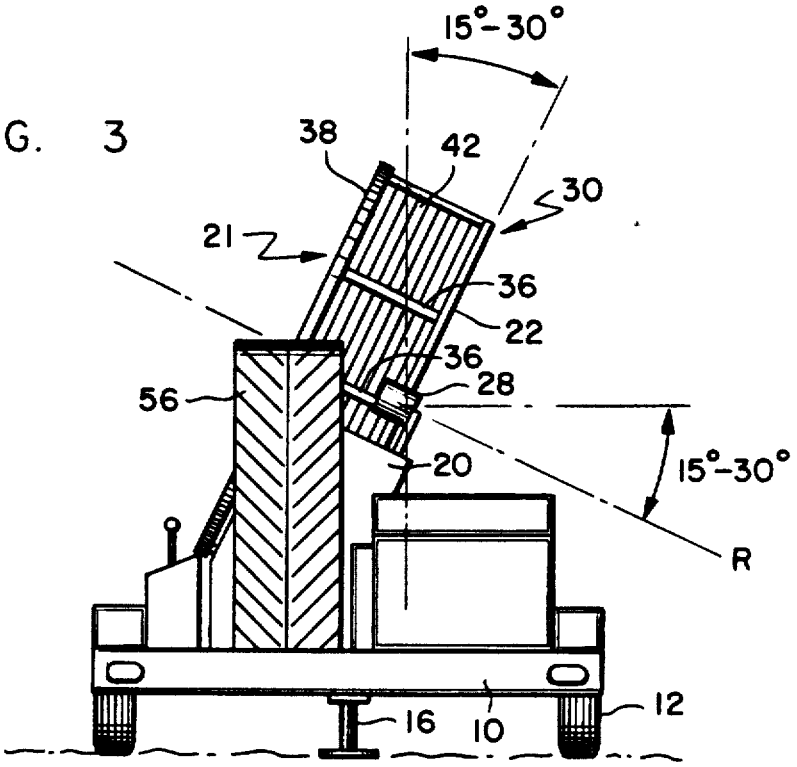
FIG. 3 is an end view of the apparatus of FIGS. 1 and 2.

The trailer frame 10 provides a means for mounting suitable vertically extending supports 18, the upper portions 20 of which are inclined at an angle to the vertical preferably within the range of 15 to 30 degrees (see FIG. 3). This angle will vary depending upon the size of the screen, the type of screen medium used in the unit and the material to be separated. However, for the apparatus of the invention to operate properly, smaller or larger angles of incline will greatly reduce the operating efficiency of the apparatus.

The supports 18 provide support for a fixed rear or bottom wall 22 that is preferably circular in shape and inclined at the same angle as the upper supports 20. A drive shaft 24 is mounted at a right angle to the supports 20 and is driven by a hydraulic motor 28 supplied with hydraulic fluid from a power unit 26. A rotatable separating unit, indicated generally by the reference numeral 21, is operatively connected to the drive shaft 24 which rotates the separating unit 21 about an axis of rotation "R". As illustrated in FIG. 3, the axis of rotation "R" is at an angle to the horizontal in the range of 15° to 30°. The separating unit 21 includes a frame, indicated generally by the reference numeral 30, that provides the supporting framework for the separating unit 21 to position unit 21 just forwardly of the rear wall 22. Frame 30 also includes spokes 32 extending radially outwardly from their inner ends which are connected to a hub 34 secured to the drive shaft 24. The outer ends of the spokes 32 are connected to circumferentially spaced side members 36 that extend parallel to the drive shaft 24. A front or outer circumferential ring 38 is supported by the side members 36. The ring 38 has an inwardly extending lip 40 around its entire inner edge for a purpose that will become evident from the description hereinafter.

Figure 6:
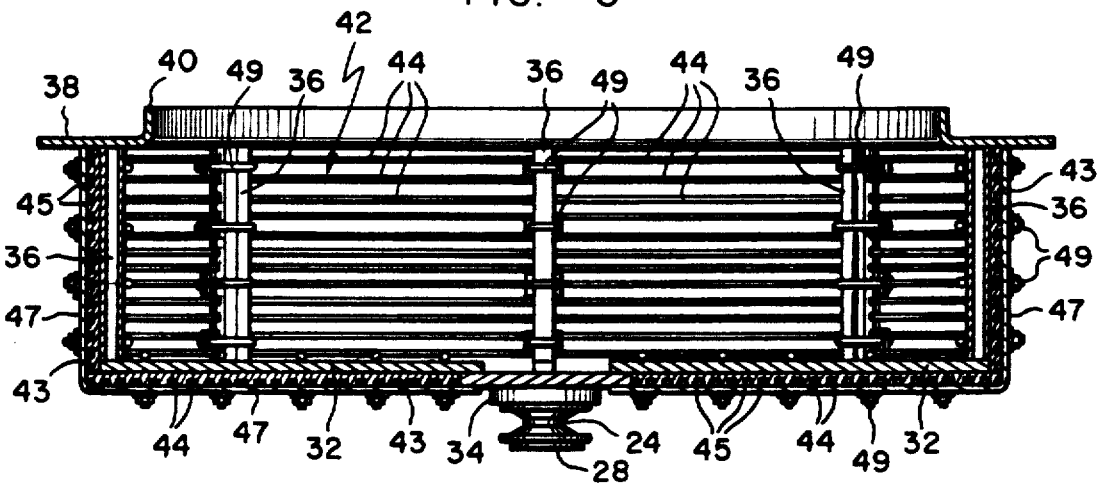
FIG. 6 is a sectional view taken on the line 6—6 of FIG. 5 to further illustrate the screen construction.
Figure 5:
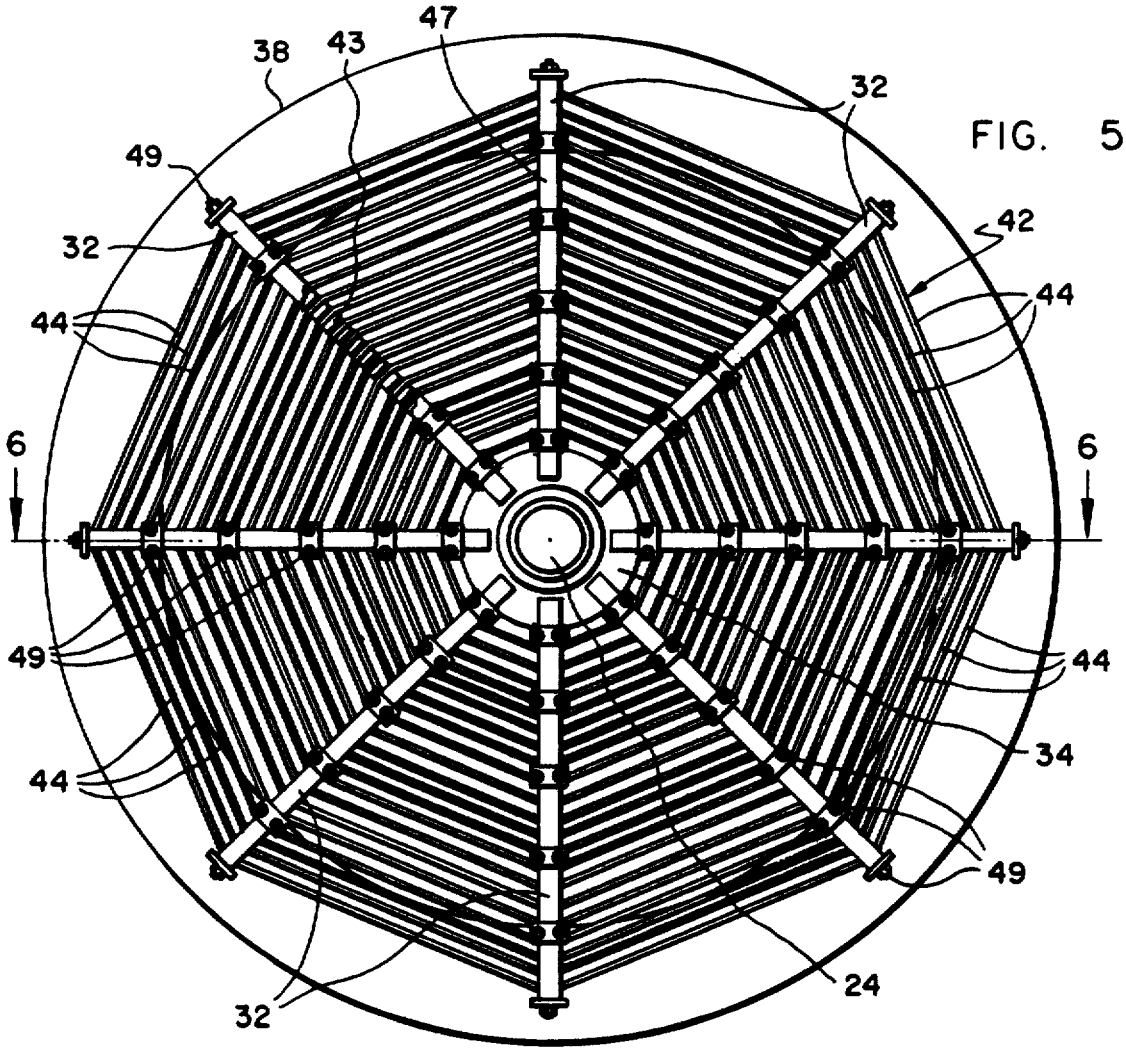
FIG. 5 is a detailed front elevational view showing one embodiment of the separating unit in which the screen is a continuous cable wrapped around the dish.

As best seen in FIGS. 5 and 6, the spokes 32 and the side members 36 provide support for a screen medium, indicated generally by the reference numeral 42, of any suitable type that defines openings the size, spacing and shape of which are determined primarily by the type of material being separated by the unit 21. As best seen in FIGS. 5 and 6, the screen medium 42 preferable is formed by a continuous cable 44 of a suitable diameter that is wound around over the side members 36 and the spokes 32 at predetermined intervals. To hold the cables 44 in the desired spaced-apart position, each side member 36 and each spoke 32 includes a first member 43 having a plurality of grooves 45 to receive the cables 44 and a second member 47 covering the grooves 45 to hold the cables 44 in the grooves 45. Suitable fasteners 49 clamp the members 43 and 47 together. Also, if the cable 44 is slightly resilient, it will assist in keeping the screen medium 42 free from plugging.

The supports 18 also provide support for a front cover 48 that extends around the front of the separating unit 21 beneath and slightly behind the ring 38. The supports 18 also provide support for side panels 50 and 52 that serve to confine and direct the screened and separated material along with the front cover 48. The front cover 48 may also provide a mounting for suitable idlers (not shown) to assist in supporting and guiding the separating unit 21 as it rotates.

In the embodiment shown in the drawings, there is illustrated the use of two conveyors. A first conveyor 54 is positioned beneath the unit 21 along the front cover 48 and serves to carry away the oversized material that is discharged out the open front of the unit 21. A second conveyor 56 has one end positioned beneath the lowest end of the unit 21 to receive the smaller particles discharged through the screen medium 42. The conveyors 54 and 56 can be powered in any suitable manner preferably utilizing the hydraulic power from the power unit 26, for example.

Figure 4:
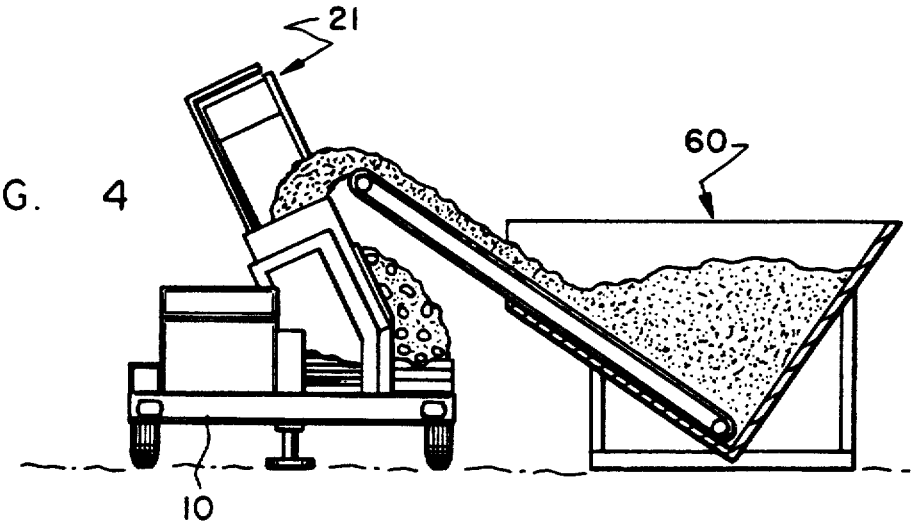
FIG. 4 is a view of the apparatus from the end opposite to that shown in FIG. 3 and illustrating a different conveyor arrangement.

In operation, the material to be separated is loaded into the open front of the unit 21 in any suitable manner, such as by a mobile bucket loader or a feeder conveyor/hopper arrangement 60 such as that illustrated in FIG. 4. With the power unit 26 rotating the separating unit 21, the material will be continuously carried up the sides of the unit 21 from where it spills downwardly across both the sides and the bottom wall 22. The material will thus be rolled over itself in a continuous motion. This orbital action causes the larger and lighter particles to emerge on the surface of the mix of material while the smaller particles will seek the bottom of the unit 21 and pass through the screen medium 42 onto the conveyor 56. Continued feeding of material into the unit 21 will eventually cause overflowing, with the oversized particles flowing out the front over the lip 40 onto the conveyor 54.

Thus, the apparatus of the invention utilizes a basic natural phenomena in which the particles of different sizes are separated due to the rolling or orbital action created by the rotating screen unit. Obviously, different conveying arrangements other than those illustrated in the foregoing description and in the drawings can be utilized to either feed the material into the apparatus or discharge the separated material. For example, if conveyor 54 is eliminated, the material can be deposited directly on the ground in front of the machine. The apparatus of the invention is useful for a variety of different materials in different operations. The apparatus of the invention has particular application for compost plant operations since materials for composting generally include a variety of materials, some of which may be wet and may also contain remnants of plastic film from trash bags, etc. The apparatus of the invention is thus very versatile and will handle materials that are difficult to screen without plugging of the screen medium.

Having thus described the invention in connection with embodiments thereof, it will be evident to those skilled in the art that various revisions and modifications can be made to the preferred embodiments disclosed herein without departing from the spirit and scope of the invention. It is my intention, however, that all such revisions and modifications as are obvious to those skilled in the art will be included within the scope of the following claims.

What is claimed is as follows:

1. An apparatus for separating dry material into different sized particles comprising: a separating unit having a top wall and a bottom wall connected by a side wall, the bottom wall and the side wall each having spaced-apart structural members that define open spaces between them, the top wall being open to provide an opening for the introduction and discharge of material into and out of the separating unit, a screen medium covering the open spaces in the bottom and side walls and having a plurality of openings of the desired size to separate material placed in the separating unit into different sized particles, support means having a fixed imperforate back wall extending substantially parallel to and spaced from the bottom wall of the separating unit, said support means also having imperforate fixed side members extending upwardly along the lower portion of the side walls of the separating unit, a shaft combined with the separating unit to provide for rotation of the unit about an axis of rotation extending transversely to the bottom wall, support means for supporting the separating unit with the axis of rotation at a selected angle between 15° and 30° to the horizontal and with the top wall facing upwardly and outwardly toward a vertical plane, and power means for rotating the separating unit about the axis of rotation at a predetermined speed, whereby material placed into the separating unit will be separated when the smaller particles of the material pass through the screen medium for discharge and the larger particles are discharged through the open top wall of the separating unit.

2. The apparatus of claim 1 in which the top and bottom walls of the separating unit are substantially circular and the separating unit is substantially cylindrical.

3. The apparatus of claim 2 in which the bottom wall structural members are spokes each having an inner end operatively connected to the shaft and radially extending outwardly and terminating in an outer end, and the side wall structural members extend between the outer ends of the spokes and the top wall.

4. The apparatus of claim 3 in which the top wall includes a circumferential ring connected to the side wall structural members, said ring having an inwardly extending lip.

5. The apparatus of claim 4 in which the screen medium comprises spaced-apart flexible cables extending around the side wall structural members and extending across the spokes, and means is provided to secure the cables to the spokes and the side wall structural members.

* * * * *